US005461973A

United States Patent [19]

Page

[11] Patent Number: 5,461,973

[45] Date of Patent: Oct. 31, 1995

[54] DRUM CRUSHER

[76] Inventor: Lew B. Page, P.O. Box 38, Bloomingdale, Mich. 49026

[21] Appl. No.: 168,182

[22] Filed: Dec. 17, 1993

[51] Int. Cl.[6] ..... B30B 9/32

[52] U.S. Cl. ..... 100/53; 100/90; 100/214; 100/902

[58] Field of Search ..... 100/53, 90, 214, 100/255, 902

[56] References Cited

U.S. PATENT DOCUMENTS

| | | | |
|---|---|---|---|
| 673,409 | 5/1901 | Nichols | 100/214 |
| 1,052,280 | 2/1913 | Satenstein | 100/214 X |
| 4,442,768 | 4/1984 | Bailey | 100/902 X |
| 4,685,391 | 8/1987 | Picker | 100/902 X |
| 4,771,686 | 9/1988 | Triantos, Jr. | 100/902 X |
| 4,809,600 | 3/1989 | Yamamoto et al. | 100/902 X |
| 5,048,413 | 9/1991 | Deiters | 100/902 X |

FOREIGN PATENT DOCUMENTS

| | | | |
|---|---|---|---|
| 595192 | 6/1959 | Italy | 100/214 |
| 1699808 | 12/1991 | U.S.S.R. | 100/902 |
| 1156139 | 6/1969 | United Kingdom | 100/902 |
| 2018190 | 10/1979 | United Kingdom | 100/214 |

OTHER PUBLICATIONS

"Economy ©Model 3630 Drum and Barrel Crusher", The Economy Baler Company, Aug. 1981.

"Lickity Barrel and Can Crusher", Piqua Engineering, May 1985.

*Primary Examiner*—Stephen F. Gerrity

*Attorney, Agent, or Firm*—James Creighton Wray

[57] ABSTRACT

A drum crusher crushes differently shaped and/or sized empty containers such as 55 gallon steel drums to facilitate recycling of the material in the make-up of the container. A compacting press actuated by remote controlled hydraulic pressure moves in the axial direction of the drums or containers with sufficient hydraulic pressure to crush the containers to a minimum size. Locating bars facilitate manual, mechanical or gravity feeding of the drums into the crushing apparatus and the manual, mechanical or gravity removal of compacted slugs from the crushing apparatus. Safety apparatus minimizes exposure of personnel to possible hazardous conditions.

24 Claims, 2 Drawing Sheets

DRUM CRUSHER

BACKGROUND OF THE INVENTION

This invention relates generally to compacting presses and specifically to compacting presses for compacting empty 55 gallon steel drums or other containers to facilitate the recycle use of the containers' structural material. Prior art compacting presses have utilized dedicated tooling, limiting to only one size the container to be compacted, still others have utilized uniaxial compression to reduce volume in three dimensional reduction, thus requiring a mold having an inner cavity having a press fit with the compressed slug and requiring a means of removing the press fit slug from the mold cavity.

SUMMARY OF THE INVENTION

It is a primary object of this invention to provide a crushing apparatus for the crushing or compacting of empty 55 gallon steel drums or differently shaped and/or sized empty containers to facilitate the recycling, handling and use of the material in the makeup of the container.

It is a further object of this invention to provide a crushing or compacting apparatus or press actuated by remote controlled hydraulic pressure movable in the axial direction of the drums or containers with sufficient hydraulic pressure to crush the containers to a minimum size.

It is a still further object of this invention to provide a container locating apparatus to facilitate the manual, mechanical or gravity feeding of the empty containers into the crushing apparatus and the manual, mechanical or gravity removal of the compacted slugs from the crushing apparatus.

It is a still further object of this invention to provide safety apparatus, air escape holes and shield to minimize exposure of personnel to possible hazardous conditions.

A preferred drum crusher crushes differently shaped and/or sized empty containers such as 55 gallon steel drums to facilitate recycling of the material in the make-up of the container. A compacting press actuated by remote controlled hydraulic pressure moves in the axial direction of the drums or containers with sufficient hydraulic pressure to crush the containers to a minimum size. Locating bars facilitate manual, mechanical or gravity feeding of the drums into the crushing apparatus and the manual, mechanical or gravity removal of compacted slugs from the crushing apparatus. Safety apparatus minimizes exposure of personnel to possible hazardous conditions.

A drum crusher compacts empty 55 gallon steel drums or other sized or shaped empty containers to facilitate the recycled use of the containers' structural material.

The drum crusher has a frame with frame members connecting a frame bed and a top cross structure. A guide is provided for guiding a ram press. Hydraulic cylinders, safety shield, and container locating bars are attached to a structural support.

A ram press moves along the guide in a single axis and is guided by a sliding fit. Rollers are attached for crushing empty 55 gallon steel drums or other sized or shaped containers.

Remotely controlled hydraulic cylinders move the ram press between a, and back to the, beginning position and a crushed position.

A hinged and movable safety shield provides a physical barrier to minimize the exposure of personnel to possible hazardous conditions.

Container locating bars provide centering and locating of a drum or other container in the drum crusher prior to crushing.

The frame bed includes a planar surface and the press ram means is movable in a direction perpendicular to the planar surface.

Safety air escape holes are provided in the press ram and in the frame bed for preventing and relieving pressure buildup in the container during crushing for minimizing exposure of personnel to possible hazardous conditions.

A compacted slug removal space is provided between the container locating bars and the frame bed for providing, should the drum crusher be placed horizontally, for the compacted slug removal from the drum crusher by falling out due to gravity when the ram press begins to retract.

One or more hinged and movable safety shields are provided as a physical barrier to minimize the exposure of personnel to possible hazardous conditions.

The container locating bars are provided as a means of centering and locating the 55 gallon drum or other containers in the drum crusher prior to the crushing operation.

Cutaways are located in the ram press for allowing the ram press to move past the container locating bars.

A preferred drum crusher compacts empty 55 gallon steel drums or other empty containers to facilitate the recycling use of the containers' structural material.

The drum crusher has a frame with a frame bed. A cross structure is spaced from the frame bed. Elongated frame members connect the frame bed and the cross structure for providing a guide for guiding a ram press and for providing a structural support for the drum crusher.

Hydraulic cylinders are connected to the frame. A safety shield at least partially surrounds the frame members and the frame bed. Container locating bars are connected to the frame members near the frame bed but spaced from the frame bed.

Rams are connected to the hydraulic cylinders. A ram press is connected to the rams. The ram press is movable along a single axis and is guided in a sliding fit by attached rollers moving along the frame members for crushing empty 55 gallon steel drums or other containers.

A hydraulic source and a remote control are connected to hydraulic cylinders for moving the ram press between a beginning position and a container-crushed position.

The safety shield is hinged to the frame members and is movable for providing a physical barrier for minimizing exposure of personnel to possible hazardous conditions.

The container locating bars provide centering and locating of a drum or other container in the drum crusher prior to crushing.

The frame bed includes a planar surface and the press ram is movable in a direction perpendicular to said planar surface.

Safety air escape holes are provided in the press ram and in the frame bed for preventing and relieving pressure buildup in the drum or container during crushing, for minimizing exposure of personnel to possible hazardous conditions.

The elongated frame members are generally horizontal. A space is provided between the container locating bars and the frame bed for providing removal of a compacted slug from the drum crusher by falling out due to gravity when the ram press begins to retract.

One or more hinged and movable safety shields are provided as a physical barrier to minimize the exposure of personnel to possible hazardous conditions.

The container locating bars are provided for centering and locating a 55 gallon drum or other container in the drum crusher prior to the crushing operation.

Cutaways are located in the ram press for providing passages for the ram press to move past the container locating bars.

These and further and other objects and features of the invention are apparent in the disclosure, which includes the above and ongoing written specification, with the claims and the drawings.

DETAILED DESCRIPTION OF THE DRAWINGS

The preferred embodiment illustrated is not intended to be exhaustive or to limit the invention to the precise form disclosed. It is chosen and described to best explain the principles of the invention and its application and practical use to thereby enable others skilled in the art to use the invention.

Figure 3:
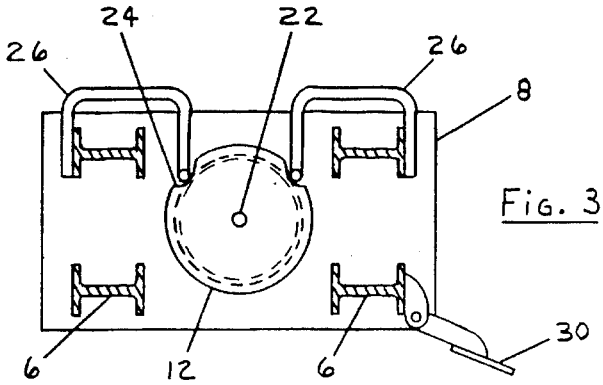
FIG. 3 is a sectional view taken along the line 3—3 in FIG. 1 illustrating the container locating bars and the cutaways in the press ram that allow the press ram to move past the locating bars.
Figure 1:
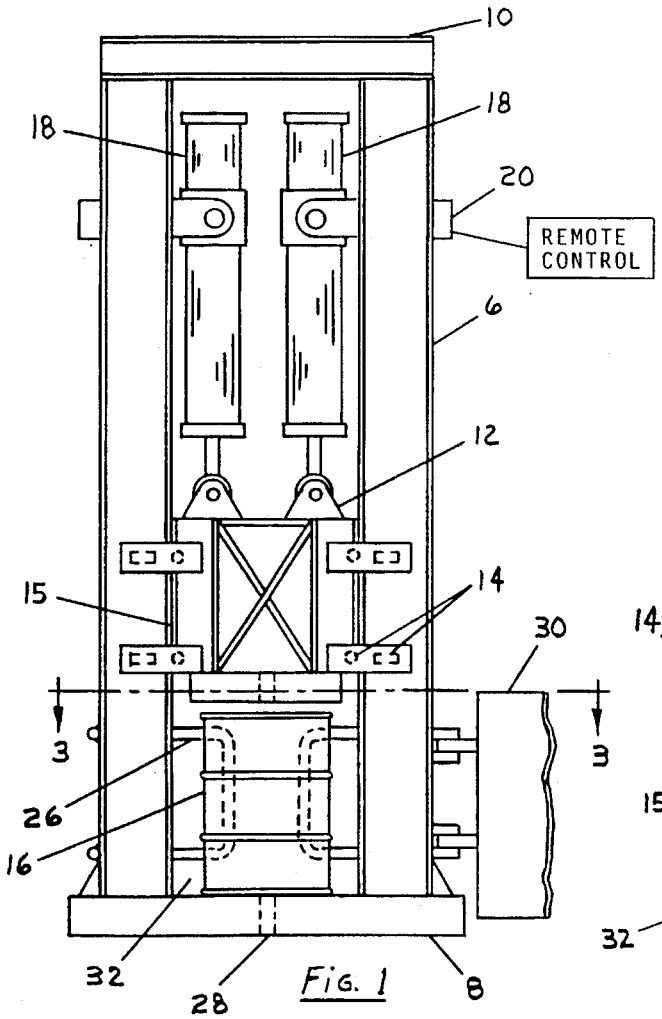
FIG. 1 is a side view illustrating the present invention with the press ram in the ready position and an empty 55 gallon steel drum in the loaded position ready to be crushed.
Figure 2:
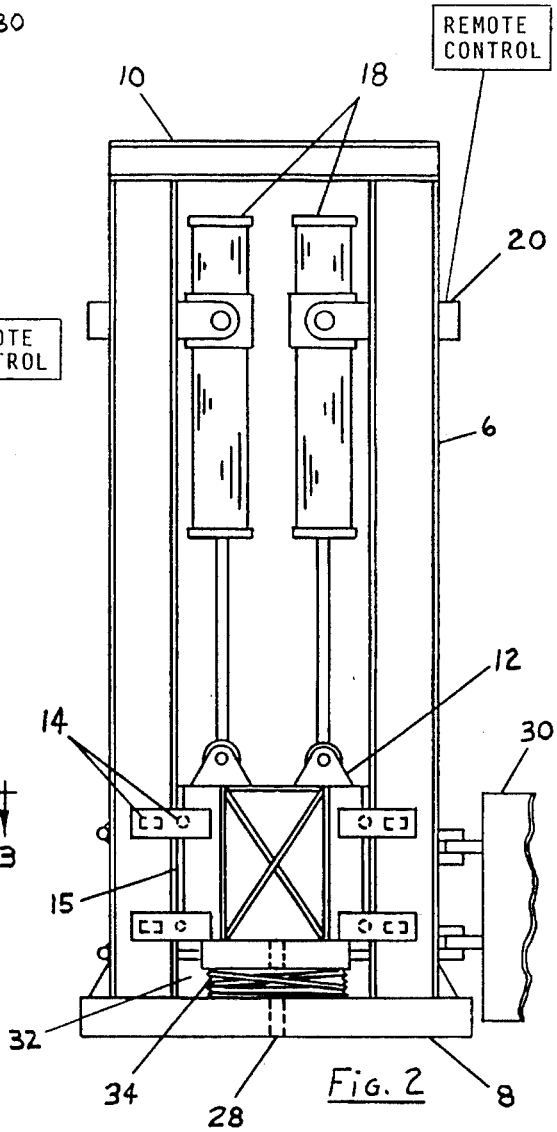
FIG. 2 is a side view illustrating the present invention with the press ram in an extended position and a crushed empty 55 gallon steel drum slug in the loaded position.

The drum crusher 1 depicted in the drawings includes an I-Beam frame 6 connecting between a frame bed 8 and an I-beam cross top frame structure 10. A ram press 12 is guided by rollers 14, shown in hidden lines, and a sliding fit 15. The ram press 12 is movable along a centrally located axis, which is parallel with an axis of the empty 55 gallon steel drum 16. Press 12 is activated by remotely controlled hydraulic cylinders 18 attached to frame 6 by cylinder arms 20. The ram press has an air escape hole 22 to relieve any pressure buildup in the container during crushing. Cutaways 24 in the press 12 allow the press ram to move past container locating bars 26, as shown in FIGS. 1 and 3. An air escape hole 28 in frame bed 8 relieves any pressure buildup in the container during crushing and minimizes exposure of personnel to possible hazardous conditions. A safety shield 30, shown in partial broken view in FIG. 1, minimizes exposure of personnel to possible hazardous conditions. A space 32 is provided between container locating bars 26 and frame bed 8 to allow for manual, mechanical, or, should the drum crusher be placed in the horizontal position, gravity removal of the compacted slug 34 upon release of ram press 12.

Figure 4:
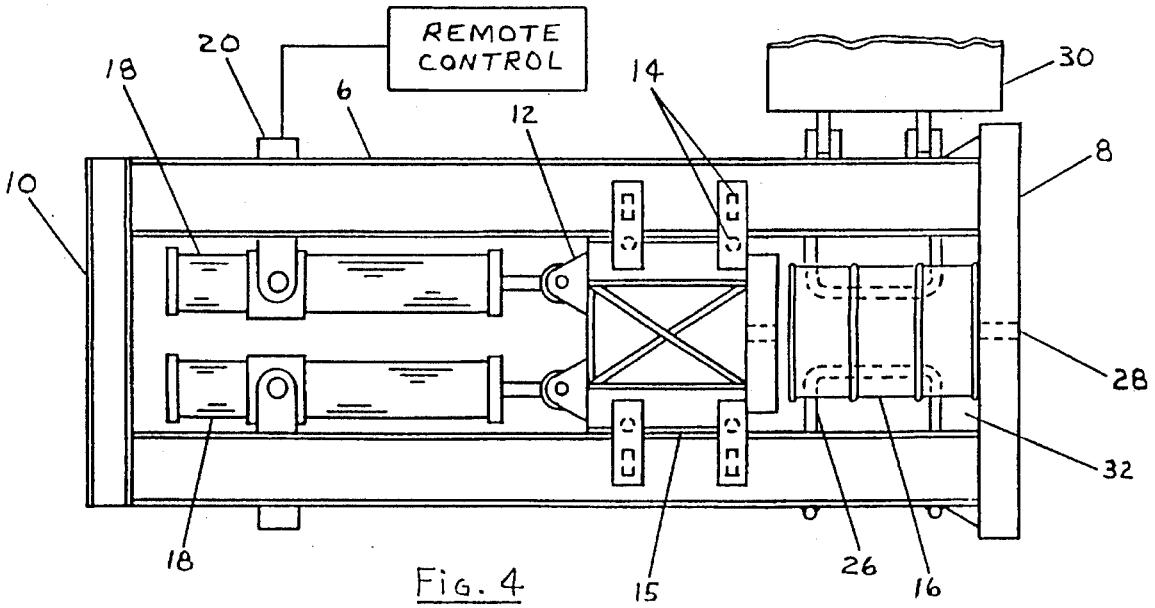
FIG. 4 is a horizontal top view of another preferred embodiment of the present invention with a drum loaded for crushing.
Figure 5:
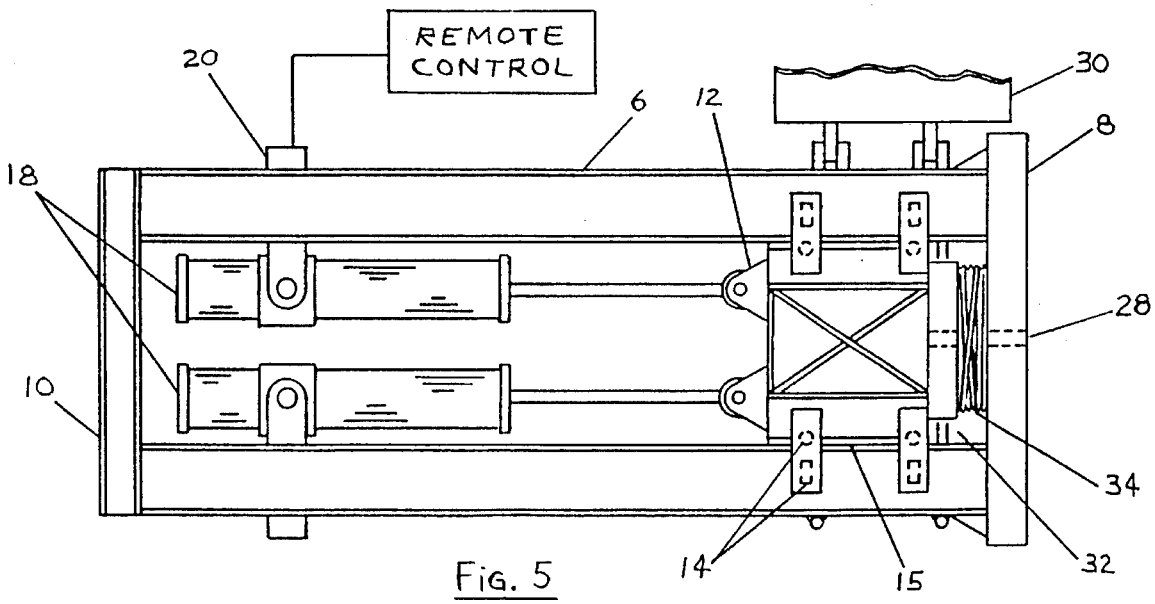
FIG. 5 is a top view of the FIG. 4 embodiment, showing a compacted slug after the crushing of the drum of FIG. 4.

The drum crusher may be used vertically, horizontally FIGS. 4 and 5 or at an angle. In the latter two cases, drums may be loaded gravitationally and may rest on the locating bars 26. Bars 26 may be adjustable or replaceable to fit specific containers, provided matching grooves or recesses 24 are provided in the head of press 12. When the crusher is vertically mounted or is mounted at a slight angle to vertical, the pushing of one drum 16 into the crusher pushes a compacted slug 34 out.

Starting with the locating of an empty 55 gallon steel drum 16, or other container, on the frame bed 8, and the centering of the container against locating bars 26, and following the closure of the safety shield 30, the press ram will crush or compact the container by the remote actuation of the hydraulic cylinders 18. The empty 55 gallon steel drum 16 is crushed into a compacted slug 34 to facilitate the recycling of the slug material. Air escape holes 22 and 28 have been provided to prevent pressure buildup during the crushing operation. The compacted slug can be removed manually or mechanically. Should the drum crusher be placed in the horizontal position as in FIGS. 4 and 5, the compacted slug 34 will fall by the action of gravity out through the space 32, upon the beginning of the retraction of the ram press 12. At the end of the retraction of the ram press, the safety shield is opened, and the drum crusher is ready for another container.

While the invention has been described with reference to specific embodiments, modifications and variations of the invention may be constructed without departing from the scope of the invention, which is defined in the following claims.

I claim:

1. A drum crusher for compacting an empty container to facilitate the recycled use of the container's structural material, said drum crusher comprising:

a frame having frame members connecting a frame bed and top cross structure, a guide attached to the frame members a structural support extending from the frame members, and container locating bars attached to the frame members;

a ram press member movable along the guide in a single axis and guided by a sliding fit and attached rollers for crushing an empty container;

remotely controlled hydraulic cylinders attached to the structural support and the ram press member for moving said ram press member between a, and back to the, beginning position and a crushed position in a crushing zone;

a hinged and movable safety shield attached to the frame for providing a physical barrier to the crushing zone to minimize the exposure of personnel to possible hazardous conditions; and the container locating bars providing centering and locating of a container in the crushing zone prior to crushing.

2. The drum crusher of claim 1, in which said frame bed includes a planar surface and said ram press member is movable in a direction perpendicular to said planar surface.

3. The drum crusher of claim 1, in which safety air escape holes are provided in the ram press member and in the frame bed for preventing and relieving pressure buildup in the container during crushing for minimizing exposure of personnel to possible hazardous conditions.

4. The drum crusher of claim 1, in which a compacted slug removal space is provided between the container locating bars and the frame bed for providing, should the drum crusher be placed horizontally, for removal of a crushed container as a compacted slug from the drum crusher crushing zone by falling out due to gravity when the ram press member begins to retract.

5. The drum crusher of claim 1, in which a plurality of hinged and movable safety shields are provided as a physical barrier to the crushing zone to minimize the exposure of personnel to possible hazardous conditions.

6. The drum crusher of claim 1, in which cutaways are located in the ram press member for allowing the ram press member to move past the container locating bars.

7. A drum crusher for compacting an empty 55 gallon steel container to facilitate the recycling use of the container's structural material, said drum crusher comprising:

a frame having a frame bed, a cross structure spaced from the frame bed, and elongated frame members connecting the frame bed and the cross structure, the frame members providing a guide and for providing a structural support for the drum crusher;

hydraulic cylinders connected to the frame, a safety shield at least partially surrounding the frame members and the frame bed, and container locating bars connected to the frame members near the frame bed but spaced from the frame bed; and rams connected to the hydraulic cylinders, a ram press member connected to the rams, the ram press member movable along a single axis and guided in a sliding fit by attached rollers moving along the guide provided by the frame members for crushing empty an 55 gallon steel container.

8. The drum crusher of claim 7, further comprising a hydraulic source being connected to said hydraulic cylinders for moving the ram press member between a beginning position and a container-crushed position.

9. The drum crusher of claim 7, wherein the safety shield is hinged to the frame members and is movable for providing a physical barrier for minimizing exposure of personnel to possible hazardous conditions.

10. The drum crusher of claim 7, wherein the container locating bars provide centering and locating of a container in the drum crusher prior to crushing.

11. The drum crusher of claim 7, wherein the frame bed includes a planar surface and wherein the ram press member is movable in a direction perpendicular to said planar surface.

12. The drum crusher of claim 7, wherein safety air escape holes are provided in the ram press member and in the frame bed for preventing and relieving pressure buildup in the container during crushing, for minimizing exposure of personnel to possible hazardous conditions.

13. The drum crusher of claim 7, wherein the drum crusher is mounted horizontally and the elongated frame members are generally horizontal, and wherein a space is provided between the container locating bars and the frame bed for providing removal of a crushed container as a compacted slug from the drum crusher by falling out due to gravity when the ram press member begins to retract.

14. The drum crusher of claim 7, wherein a plurality of hinged and movable safety shields are provided as a physical barrier to minimize the exposure of personnel to possible hazardous conditions.

15. The drum crusher of claim 7, further comprising cutaways located in the ram press member for providing passages for the ram press member to move past the container locating bars.

16. A crushing apparatus for compacting a container comprising a frame including a frame bed at one end and a cross structure at another end, and a support attached to the cross structure, plural hydraulic cylinders attached to the support, a guide connected to the support, a ram press member provided within the guide and connected to the hydraulic cylinder, said ram press member being movable along the guide, plural rollers attached to the ram press member for assisting in guiding the ram press member, a remote control connected to the hydraulic cylinders for controlling the hydraulic cylinders for moving said ram press member between plural positions, and plural container locating bars for centering and locating the container in the crushing apparatus prior to crushing.

17. The apparatus of claim 16, wherein the bed comprises a planar surface and said ram press member is movable in a direction perpendicular to said planar surface.

18. The apparatus of claims 16, further comprising plural safety air escape holes in the ram press member and in the frame bed for preventing and relieving pressure buildup in the containers during crushing.

19. The apparatus of claim 16, further comprising a compacted slug removal space between the container locating bars and the frame bed for removal of a compacted slug of a crushed container.

20. The apparatus of claim 16, further comprising at least one hinged and movable safety shield attached to the frame and forming a physical barrier to minimize exposure of personnel to possible hazardous conditions.

21. The apparatus of claim 20, wherein the at least one safety shield is hinged to the frame and at least partially surrounds the frame.

22. The apparatus of claim 16, wherein the ram press member comprises plural cutaways for providing passages for the ram press member to move past the container locating bars.

23. The apparatus of claim 16, wherein the frame further comprises elongated generally horizontal frame members connecting the frame bed and cross structure.

24. The apparatus of claim 23, wherein a space is provided between the container locating bars and the frame bed for removal of a crushed container as a compacted slug falling off due to gravity when the ram press member begins to retract.

* * * * *